United States Patent [19]

Sato

[11] Patent Number: 4,811,884

[45] Date of Patent: Mar. 14, 1989

[54] STAPLER

[76] Inventor: Hisao Sato, Daini-hikariso, 10, Toyotamaminami 3-Chome, Nerima-ku, Tokyo, Japan

[21] Appl. No.: 99,939

[22] Filed: Sep. 23, 1987

[30] Foreign Application Priority Data

Mar. 10, 1987 [JP] Japan ..... 62-34991[U]

[51] Int. Cl.[4] ..... B25C 5/04

[52] U.S. Cl. ..... 227/83; 227/155

[58] Field of Search ..... 227/83, 155

[56] References Cited

U.S. PATENT DOCUMENTS 4,051,991 10/1977 Goodchild ..... 227/155
4,227,638 10/1980 Medina et al. ..... 227/155
4,358,043 11/1982 Chi ..... 227/155

FOREIGN PATENT DOCUMENTS 61-89482 6/1986 Japan .

*Primary Examiner*—Paul A. Bell

*Attorney, Agent, or Firm*—Frank J. Jordan; C. Bruce Hamburg; Manabu Kanesaka

[57] ABSTRACT

Disclosed is a stapler which comprises a main body portion having at its one end a staple accommodating portion provided with a staple drive-out opening, a pressing lever portion pivotally attached at its one end to the other end of the main body portion, and a base portion having a guide groove disposed at a position which comes in opposition to the staple drive-out opening for curving stapling leg portions of one staple so as to be close to each other. The staple drive-out opening is formed to be narrower in width at a lower staple driving-out side than an upper staple pressing side, whereby when the staple is driven out of the staple drive-out opening, the stapling leg portions of the staple is forcedly curved so as to make the respective free ends of the staple drive-out opening come into contact with each other while piercing into an object to be stapled. Accordingly, fixing of flaps of a box, fixing of a slip or the like on a box, etc., can be performed without putting the guide groove of the base portion on the under surface of the object to be stapled.

1 Claim, 9 Drawing Sheets

STAPLER

BACKGROUND OF THE INVENTION

1. Field of the Invention

The present invention generally relates to a stapler for stapling sheets of paper, sheets of corrugated cardboard, sheets of thin plywood, or the like, and particularly relates to a stapler in which a slip or the like can be stapled on such sheets of paper, sheets of corrugated cardboard, or the like, without putting any base member acting as a staple matrix against the rear surface of the sheets.

2. Description of the Prior Art

A stapler is widely used, for example, in the case where a plurality of forms are bundled up into a form of accumulation or in the case where flaps of a paper box or a corrugated carton are fastened. Taking into consideration capability of penetrating meterials to be stapled, each of staples used for such a stapler as described above is formed of a linear body of wire and provided with a supporting portion and a pair of parallel stapling leg portions extending from the opposite ends of the supporting portion substantially perpendicularly thereto. The stapler is constituted by three members, that is, a base member having a matrix in which a bending groove for bending the stapling leg portions of a staple is formed; a staple supporting member accommodating staples and having a staple drive-out opening formed in opposition to the bending groove; and a pressing lever member disposed behind the staple drive-out opening for pressing the staples toward the staple drive-out opening. These three members are pivotally supported at an end portion of the staple supporting member opposite to the stable drive-out opening. Further, the staples are pressed by the pressing lever member toward the staple drive-out opening in the staple supporting member so that forward one of the staples is always located at the staple drive-out opening.

In stapling, a stack of sheets of paper to be stapled are inserted between the matrix of the base member and the staple supporting member so as to bring a portion to be stapled of the stack of sheets into the position where the matrix and the staple drive-out opening are faced to each other, and the pressing lever member is pressed down toward the base member. Then, the forwardmost one of the staples is pinned ino the stack of sheets through the staple drive-out opening to pass through the stack of sheets. Both the forward free ends of the stapling leg portions of the staple abut on the groove bottom of the bending groove in the matrix and then bent by about 90 degrees along the shape of the groove bottom of the bending groove by the pressure exerted by the pressing lever member, so that the sheets of paper are stapled between the matrix of the base member and the staple supporting member into a stapled accumulation.

In such a stapler as described above, however, it is necessary to insert sheet materials between the matrix of the base member and the staple supporting member in order to bend both the forward ends of stapling leg portions of a staple. Therefore, stapling cannot be carried out in the case where the distance between an edge of the sheet materials and a portion to be stapled of the same sheet materials is longer than the distance between the drive-out opening of the stapler and the pivotal point of the three members, that is, the base member, the staple supporting member, and the pressing member.

Particularly, in the case where flaps of corrugated carton of various sizes are stapled, there has been such a disadvantage that it is necessary to prepare a stapler which is so designed that the distance between the drive-out opening of the stapler and the pivotal point of the above-mentioned three members is selected to be substantially equal to the maximum distance between an edge of flaps and a portion to be stapled of corrugated carton of various sizes.

Accordingly, the inventor of this application has proposed a stapler by which sheets of paper or the like can be stapled without using any base member, as disclosed in Japanese Utility Model Unexamined Publication No. 61-89482 laid open June 11, 1986 (Japanese Utility Model Registration Application No. 59-174937 filed Nov. 20, 1984). In this stapler, staples each having a pair of stapling leg portions which have been curved inward at an extent in advance are used, and a push-out guide is provided so that when one of the staples is pushed out through a staple drive-out opening of a staple supporting member, the stapling leg portions of the staple are forced to further bend inward. As a result, the stapler can be bent without being guided by a matrix of a base member, and therefore stapling can be easily carried out by only putting the stapler on a desired portion of the upper surface of materials to be stapled and pushing out one staple by a pressing lever member of the staple. This stapler is effectively used particularly in the case where an address tag or the like is temporarily attached on a corrugated carton. In the foregoing stapler, however, there has been a disadvantage in that the stapler is so complicated in structure that mass production cannot be carried out on the stapler and therefore the stapler cannot be provided at a low cost.

SUMMARY OF THE INVENTION

It is an object of the present invention to provide a stapler capable of stapling sheets of paper or the like without using a base member and having a simple structure.

It is another object of the present invention to provide a stapler in which through a simple operation a staple is caused to pass through a plurality of objects in the desired number to be stapled and bent on the back surface of the lowermost object so as to form the objects into a stapled accumulation similarly to a conventional stapler.

It is a further object of the present invention to provide a stapler in which a sheet material, such as paper or the like, or a netty material can be fastened on a thick material such as corrugated cardboard, plywood, or the like.

In order to attain the above objects, according to the present invention, the stapler comprises: a main body portion provided at its one end with a staple accommodating portion for accommodating staples, the staple accommodating portion having a staple drive-out opening which is formed to be narrower in width at a staple driving-out side than a staple pressing side; a pressing lever portion pivotally attached at its one end to the other end of the main body portion, the pressing lever portion having a staple drive-out member disposed on a back surface at the other end of the pressing lever portion for pressing an upper portion of one of the staples disposed in the staple drive-out opening; and a base portion capable of being selectively disposed on a lower end surface of the main body portion and having a guide groove disposed at a position which comes in opposition to the staple drive-out opening for curving stapling leg portions of the one staple so as to be close to each other when the base portion is disposed on the lower end surface of the main body portion.

In the thus arranged stapler according to the present invention, a staple is formed to have a substantially linear supporting portion and a pair of stapling leg portions extending from opposite ends of the supporting portion substantially perpendicularly to the linear supporting portion, the pair of stapling leg portions being curved in a direction so that respective free ends of the pair of stapling leg portions approach toward each other, whereby the free ends of the stapling leg portions are slantingly pinned into objects when the staple is being passed through the drive-out opening and further bent inward when the staple leaves the drive-out opening. Therefore the staple can be fixed without causing a base portion to abut on the lower surface of the objects.

BRIEF DESCRIPTION OF THE DRAWINGS

The above and other objects and advantages of the present invention will be apparent from the following detailed description about the embodiments taken in conjunction with the accompanying drawings, in which:

FIGS. 15*a* and 15*b* are views showing the staple drive-out portion, in which FIG. 15*a* is a front view showing the staple drive-out plate member of the staple drive-out portion and FIG. 15*b* is a perspective view showing the spring receptor of the staple drive-out portion;

FIGS. 18*a* and 18*b* are views showing the staples, in which FIG. 18*a* is a perspective view showing a bar of staples, and FIG. 18*b* is a plan showing one of the staples;

FIGS. 19*a* and 19*b* are views showing the state of initiation of the driving out of a staple, in which FIG. 19*a* is a view showing a state before the staple is driven, and FIG. 19*b* is a view showing a state where the staple is being driven out.

DETAILED DESCRIPTION OF THE PREFERRED EMBODIMENTS

Embodiments according to the present invention will be described hereunder with reference to the accompanying drawings.

Figure 1:
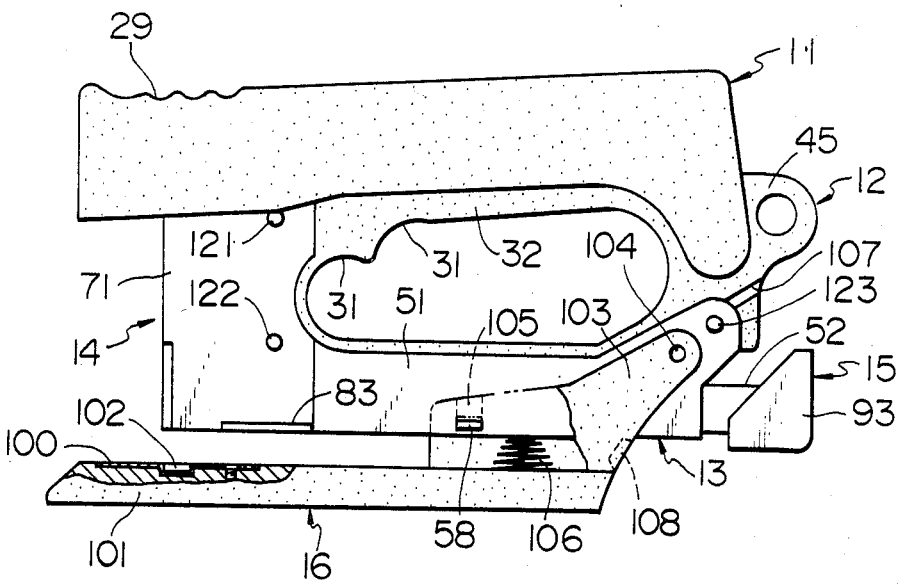
FIG. 1 is a partially cutaway front view showing an embodiment of the stapler according to the present invention.
Figure 2:
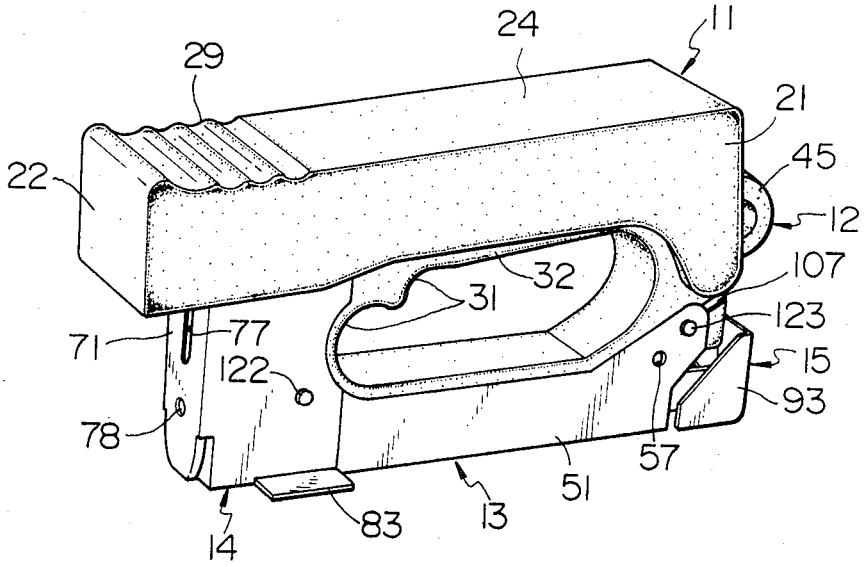
FIG. 2 is a perspective view showing the embodiment of FIG. 1 is the state where the base portion is removed.
Figure 3:
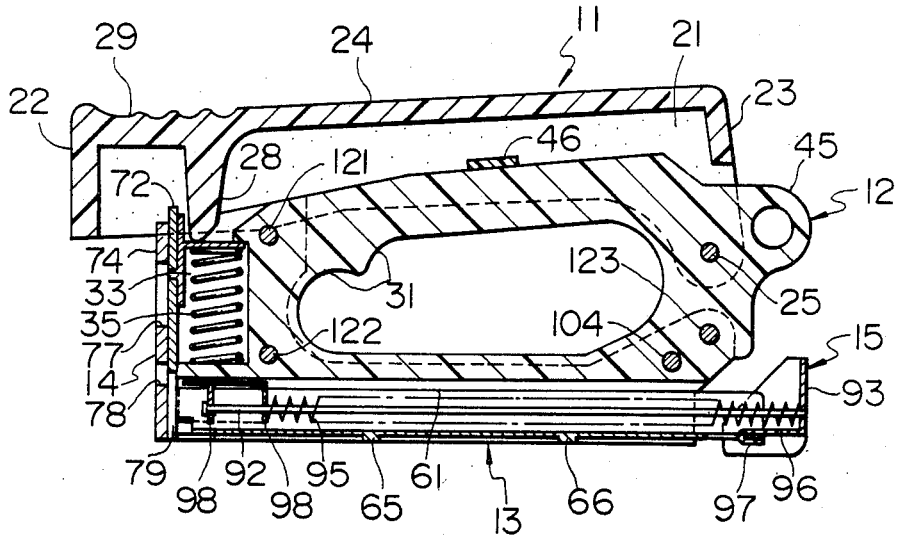
FIG. 3 is a longitudinal cross section showing the embodiment of FIG. 2.
Figure 4:
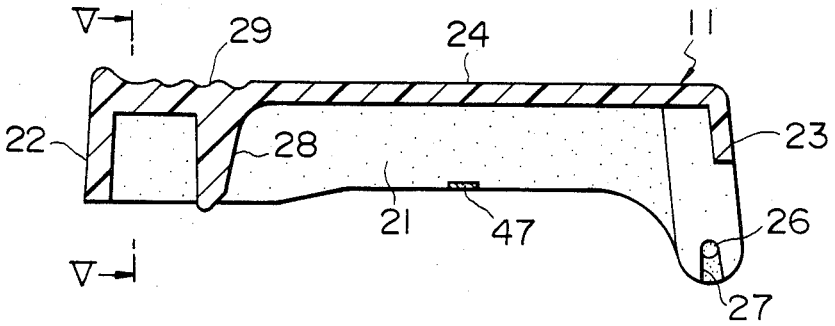
FIG. 4 is a longitudinal cross section showing the pressing lever portion.
Figure 5:
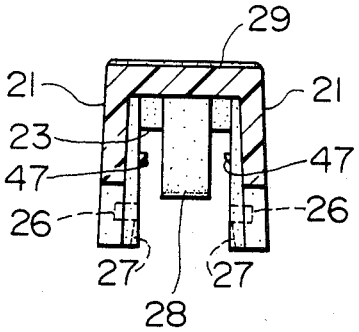
FIG. 5 is a transversal cross section taken on line V—V of FIG. 4.
Figure 6:
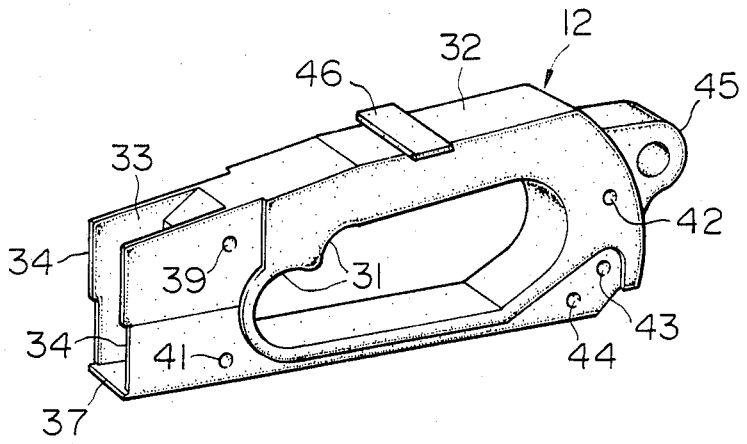
FIG. 6 is a perspective view showing the main body portion.
Figure 7:
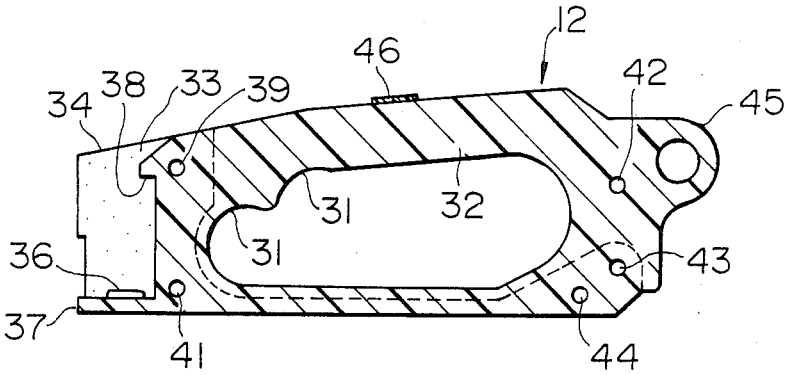
FIG. 7 is a longitudinal cross section showing the main body portion of FIG. 6.
Figure 8:
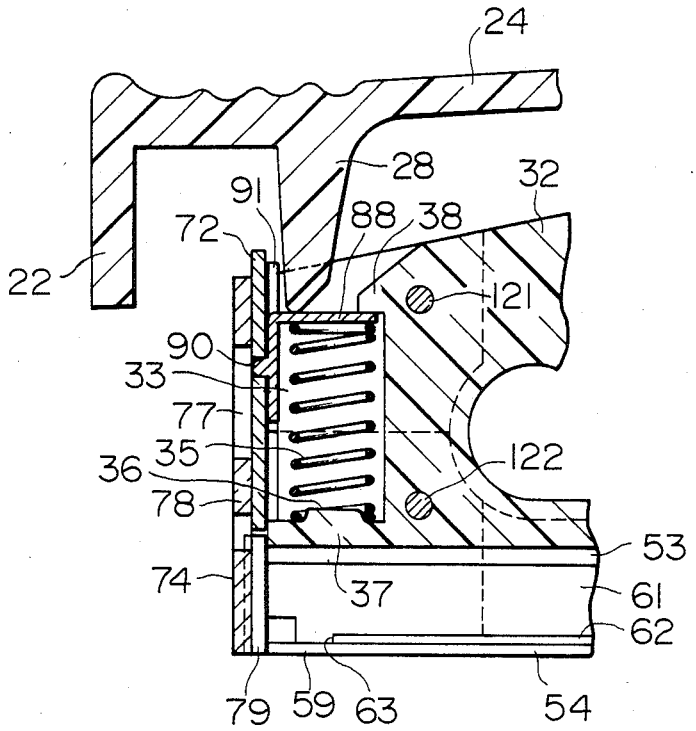
FIG. 8 is a transversal cross section for explaining the relationship between the front end portion of the pressing lever portion and that of the main body portion.

Referring to FIG. 1, in general, the stapler according to the present invention is constituted by a pressing lever portion 11, a main body portion 12 pivotally supporting an end of the pressing lever portion 11, a staple guide portion 13 provided at a lever portion of the main body portion 12, a staple drive-out portion 14 provided at the respective front end portions of the main body portion 12 and the staple guide portion 13, a staple push-out portion 15 provided on the staple guide portion 13, and a base portion 16 provided under the staple guide portion 13.

As shown in detail in FIGS. 1 through 5, the pressing lever portion 11 integrally formed of synthetic resin such as a plastic material or the like has a pair of longitudinal side portions 21 and 21, a front and a rear end portion 22 and 23 disposed on the opposite ends of the longitudinal side portions 21 and 21, and a roof plate portion 24. The terms "front" and "rear" are used throughout this specification to indicate the left and right in the drawings respectively. A rear end portion of each of the longitudinal side portions 21 and 21 is formed so as to extend downward in comparison with a front end portion of the same, and supporting holes 26 opposite to each other are formed in the respective inner surfaces of the rear end portions of the longitudinal side portions 21 and 21 so that the opposite ends of a supporting shaft 25 are rotatably fitted in the supporting holes 26. Guide grooves 27 for guiding insertion of the supporting shaft 25 into the supporting holes 26 are formed in the respective lower edge portions of the rear end portions of the longitudinal side portions 21 and 21, the depth of each of the guide grooves 27 being reduced toward the supporting hole 26. A staple drive-out member 28 extending downward is formed integrally with the back surface of the roof plate portion 23 at the front end portion thereof. An uneven portion 29 for slip prevention is formed in the surface of the roof plate portion 23 at the front end portion thereof.

Figure 9:
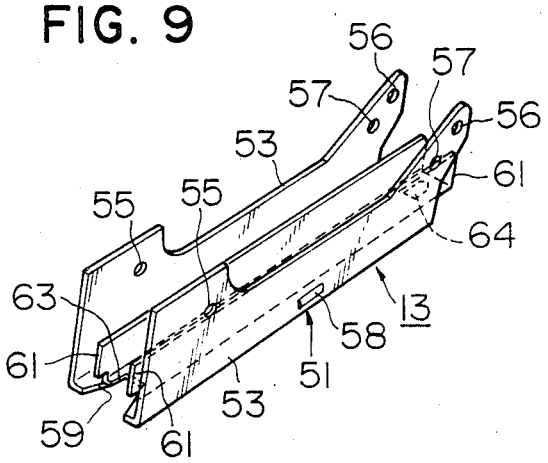
FIG. 9 is a perspective view showing the staple guide portion.
Figure 10:
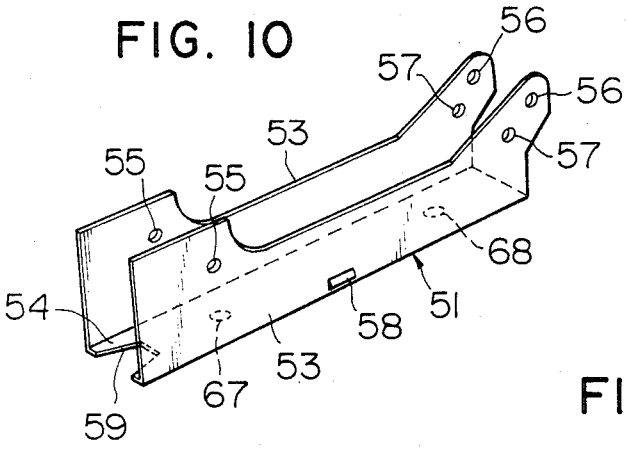
FIG. 10 is a perspective view showing the outside guide means of the staple guide portion of FIG. 9.
Figure 11:
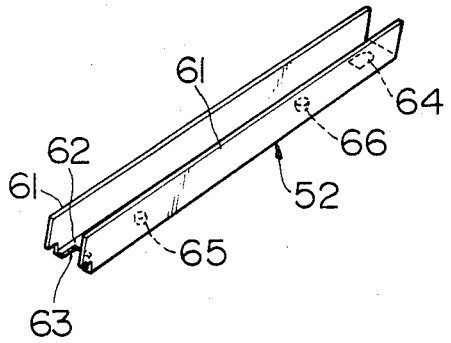
FIG. 11 is a perspective view showing the inside guide means of the staple guide portion of FIG. 9.

Referring to FIGS. 1 through 3 and FIGS. 6 through 8, the main body portion 12 of synthetic resin such as a plastic material or the like is generally annularly shaped, and arranged so as to be partly removably fitted in an lower opening of the pressing lever portion 11. The main body portion 12 is constituted by a grip portion 32 and a spring accommodating portion 33 provided at a front end portion of the grip portion 32. The grip portion is provided with finger guides 31 at an inside front portion thereof so that fingers can be surely put on the grip portion in operation. The main body portion 12 has a sufficient length so as to be fitted in the pressing lever portion 11 over a portion thereof from the vicinity of the staple drive-out member 28 to the rear end portion of the pressing lever portion 11. The spring accommodating portion 33 is constituted by two thin side wall portions 34 so that the pressing lever portion 11 is vertically movably inserted therebetween, and a receiving plate portion 37 formed integrally with the two thin side wall portions 34 at a lower portion thereof. A projection 36 is formed at a center portion of the receiving plate portion 37 so that a lower end of a coil spring 35 is fitted on the receiving plate portion 37. The respective upper front end portions of the side wall portions 34 are slightly projected frontwards than the respective lower front portions of the same. The grip portion 32 is provided at its upper front end portion with a projection portion 38 having a lower end surface extending parallel to the receiving plate portion 37. Two upper and lower through holes 39 and 41 are formed in the front end portion of the grip portion 32, and an upper through hole 42 and two lower through holes 43 and 44 are formed in the rear end portion of the grip portion 32, the holes 43 and 44 being separated from each other substantially in the transverse direction as well as slightly in the vertical direction. The supporting shaft 25 is inserted into the through hole 42. The remainder through holes 39, 41, 43, and 44 will be described later. An engagement/stopper projection 45 having an opening at its center portion is formed on a rear edge portion of the grip portion 32, the engagement/stopper projection 45 being engaged with the rear end portion 23 of the pressing lever portion 11 so as to prevent the pressing lever portion 11 from being spread excessively. The respective outer surfaces of the side wall portions 34 of the spring accommodating portion 33 and the lower outer surfaces of the grip portion 32 are formed to be slightly lower than the remainder outer surfaces of the grip portion 32, and the respective lower outer surfaces of the side wall portions 34 of the spring accommodating portion 33 are further lowered. An engagement/-stopper member 46 extending perpendicularly to the front-rear direction is stuck on or formed integrally with the upper surface of the grip portion 32 substantially at the central portion. The opposite ends of the engagement/stopper member 46 are slightly projected from the opposite side surfaces of the grip portion 32, so that the respective projected portions of the member 46 are located respectively above engagement/stopper portions 47 and 47 formed on inner surface lower ends of the longitudinal side portions 21 and 21 of the pressing lever member 11 and are extended beyond those engagement/stopper portions 47 and 47 to thereby prevent the pressing lever member 11 from separating from the main body portion 12. As shown in FIGS. 9 through 11, the staple guide portion 13 is provided with an outside guide means 51 and an inside guide means 52. The outside guide means 51 is formed by bending a metal plate into a generally rectangular tub-like or channel-like shape opened at its upper portion, and the inside guide means 52 is formed by bending a metal plate into substantially the same shape as that of the outside guide means 51 and fixed in the outer guide means 51 by spot welding or the like with a suitable gap between the outside and inside means 51 and 52. The outer guide means 51 is constituted by a pair of side portions 53 and 53 and a bottom portion 54 so that the lower end portion of the main body portion 11 receives therein the pair of side portion 53 and 53 so as to leave a gap between the bottom surface of the lower end portions and the bottom portion 54. Through holes 55, 56, and 57, which are communicated with the through holes 41, 43, 44 respectively when the main body portion 11 receives the side portions 53 and 53, are formed in the side portions 53 and 53, and engagement/stopper portions 58 projecting outward are formed integrally with the respective central lower portions of the outer surfaces of the side portions 53 and 53. A notch portion 59 is formed in a front end portion of the bottom portion 54 so that a staple can be driven out through the the notch portion 59.

The inside guide means 52 is constituted by side portions 61 and 61 which are reduced in height in comparison with the side portions 53 and 53 of the outside guide means 51, and a bottom portion 62 having a width smaller than that of the bottom portion 54 of the outside guide means 51, and is arranged in such a manner that a gap is formed between the respective upper edges of the side portions 61 and 61 and the bottom surface of the main body portion 11 and another gap is formed between the side portions 61 and 61 and the corresponding side portions 53 and 53 of the outer guide means 51 when the lower end portion of the main body portion 11 is sandwiched between the side portions 53 and 53 of the outside guide means 51, so that a path is formed for accommodating staples and the staple push-out portion 14. This inside guide means 52 is attached as shown in FIG. 9 to the outside guide means 51 in such a manner that the front end of the former is located behind that of the latter and the rear end of the former is projected beyond that of the latter. A notch portion 63 for driving-out a staple is formed in the bottom portion 62 of the inside guide means 52 at the front end thereof so that a staple can be driven out through the notch portion 63, and an engagement/stopper hole 64 is formed in the bottom portion 62 of the inside guide means 52 at the rear end thereof. Further, a pair of positioning pins 65 and 66 projecting downward are provided on the bottom portion 62 of the inside guide means 52 separately from each other in the front-rear direction so as to perform positioning of the inside guide means 52 relative to the outside guide means 51. Those positioning pins 65 and 66 are fitted into positioning holes 67 and 68 which are formed in the bottom portion 54 of the outside guide means 51 so as to be opposite to the positioning pins 65 and 66 respectively as shown in FIG. 10.

Figure 12:
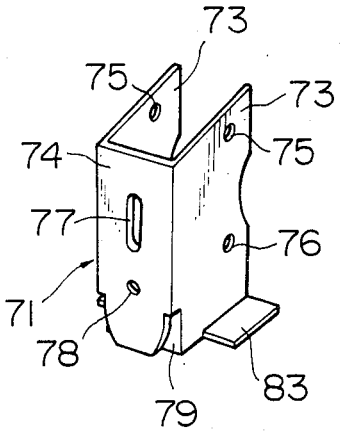
FIG. 12 is a perspective view showing the staple drive-out portion.
Figure 13:
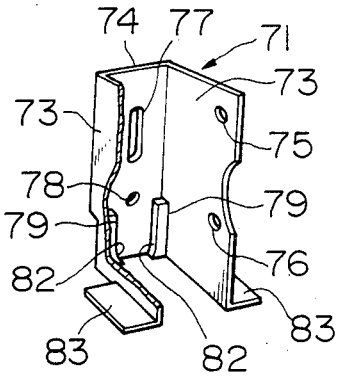
FIG. 13 is a partially cutaway perspective view showing the staple drive-out portion viewed from the rear surface of the staple push-out portion.
Figure 14:
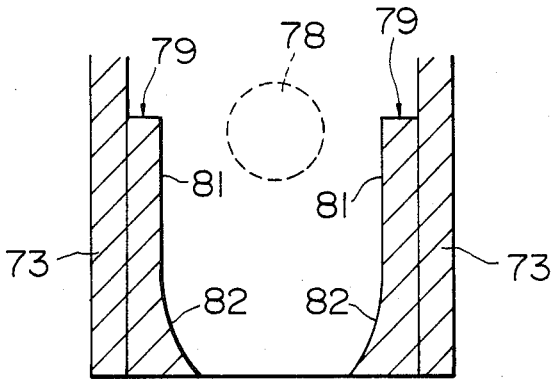
FIG. 14 is a transversal cross section showing the front end portion of the staple drive-out portion.

Referring to FIGS. 12 through 14 and FIGS. 15a and 15b, the staple drive-out portion 14 is provided with an outer peripheral frame member 71 and a staple drive-out plate member 72, the frame member 71 is bent into a generally rectangular shape so as to cover a front end opening portion formed between the side wall portions 34 constituting the spring accommodating portion 33 of the main body portion 12. Specifically, as shown in FIGS. 12 through 14, the outer peripheral frame member 71 formed of a metal plate is constituted by side surface portions 73 and 73 for covering the outer surfaces of the side wall portions 34 and a front end surface portion 74 for covering the front end opening portion between the side wall portions 34. The side surface portions 73 and 73 are provided with through holes 75 and 76 which are communicated with the through holes 39 and 40 in the side wall portions 34 respectively when the staple drive-out portion 14 is attached onto the side wall portions 34. The front end surface portion 74 is provided with a vertically elongated hole 77 and a peep hole 78 for observing the staples at its upper and lower portions respectively. As shown in FIG. 13, a pair of guide members 79 each having a thickness substantially equal to the thickness of one staple are fixed on the back surface of the front end surface port 74 at the lower end opposite corners thereof. The respective guide members 79 have upper linear surface portions 81 parallel to each other and lower curved surface portions 82 each having a predetermined radius of curvature. The distance between the linear portions 81 is selected to be substantially equal to the width of the staple (the width of the staple means the maximum outside dimension of the staple width in the horizontal direction in FIG. 18*b*), and the distance between lower end edges of the curved surfaces 82 is made smaller than the width of the staple (see FIG. 14). An opening portion between those curved surfaces 82 and 82 is provided for driving out a staple. Substantially horizontally extending rib portions 83 are formed on the outer surface lower end portions of the side surface portions 73 and 73. The guide members 79 and 79 may be formed integrally with the opposite corner portions of the back surface of the front end surface portion 74. Alternatively, the guide members 79 and 79 may be fixed to or formed integrally with the front end portion of the outer guide means 51 of the staple guide portion 13.

Figure 15A:
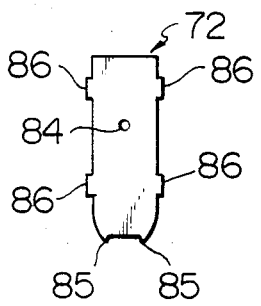
Figure 15B:
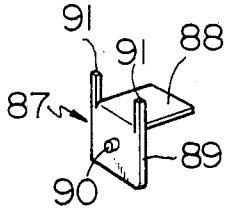

As shown in FIG. 15*a*, the staple drive-out plate member 72 disposed in the outer peripheral frame member 71 is formed by one metal plate, such as steel or the like, having a high mechanical strength and wear resistance, the width of the staple drive-out plate member 72 being selected to be smaller than that of the staple, the thickness of the former being selected to be slightly smaller than that of the latter. The staple drive-out plate member 72 is provided by an engagement/stopper hole 84 and tusk-like guiding projections 85 at an upper central portion and lower opposite end portions thereof, so that the lower end surface of the staple drive-out plate member 72 is caused to engage with the upper surface of a staple so as to drive out the staple while guiding the staple at the opposite ends of the staple with the guide projections 85. Upper and lower projecting portions 86 separated from each other with a predetermined interval are formed on each of the opposite side edges of the staple drive-out plate member 72. The distance between the respective free ends of the projection portions 86 and 86 located at the same level is made substantially equally to that between the back surfaces of the opposite side surface portions 73 of the outer peripheral frame 71. The staple drive-out plate member 72 is attached onto a spring receptor 87 shown in FIG. 15*b*. That is, the spring receptor 87 is bent substantially into a reversed L-shape so as to have a horizontal portion 88 and a vertical portion 89 extending downward from an end of this horizontal portion 88. The staple drive-out plate member 72 and the spring receptor 87 are attached to each other in such a manner that an horizontally extending support shaft 90 attached to substantially central portion of the vertical portion 89 is fitted into the engagement/stopper hole 84 of the staple drive-out plate member 72. The free end portion of the horizontal portion 88 opposite to the vertical portion 89 abuts on the lower surface of the projection portion 38 of the main body portion 12 when the spring receptor 87 is moved to the uppermost position by the coil spring 35. Further, in this embodiment, the width of the horizontal portion 88 is selected to be smaller than that of the vertical portion 89 to thereby form arm portions 91 and 91 at the opposite sides of the horizontal portion 88, the arm portions 91 and 91 being disposed in the same plane as the vertical port 89 so that those arm portions 91 and 91 also abut on the back surface of the staple drive-out plate member 72.

Figure 16:
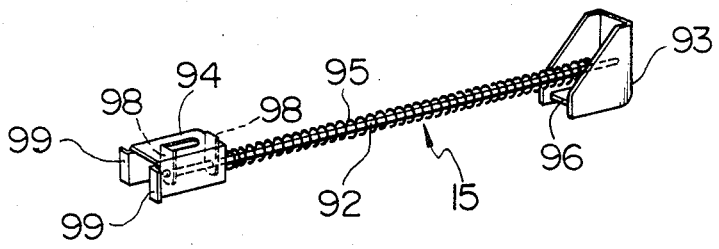
FIG. 16 is a perspective view showing the staple push-out portion.

Referring to FIG. 16, the staple push-out portion 15 is provided with a metal rod member 92, a lever portion 93 fixed to an end of the rod member 92 and formed by bending a metal plate into a generally rectangular shape, a staple engagement portion 94 slidably supported by the rod member 92 and formed by bending a metal plate into a generally rectangular shape similarly to the lever portion 93, and a coil spring 95 inserted between those lever portion 93 and the staple engagement portion 94 and having a central hole through which the rod member 92 is inserted. The lever portion 93 is provided with a bottom portion 96 formed integrally therewith, and an engagement/stopper portion 97 (FIG. 3) for engaging with the engagement/stopper hole 64 of the inside guide means 52 is formed integrally with the bottom portion 96 by punching and bending a portion of the bottom portion 96.

The staple engagement portion 94 is attached to the rod member 92 with its lower portion opened. The attachment of the staple engagement portion 94 to the rod member 92 performed in such a manner that the roof portion is partly punched and bent downward to form two supporting portions 98 disposed separately from each other in the front-rear direction, and the rod member 92 is slidably inserted through enter holes formed in the respective supporting portions 98. Front ends of the opposite side portions of the staple engagement portion 94 are bent substantially at right angles so as to form staple abutment portions 99.

Referring to FIG. 1, the base portion 16 is provided with a flat base member 101 disposed below the staple guide portion 13 and the staple drive-out portion 15, and a metal matrix 100 attached to the upper surface of the base member 101 substantially at the front end portion thereof. Similarly to the conventional stapler, a guide groove 102 for bending the opposite ends of a staple inward is formed in the matrix 100. The base member 101 is formed of synthetic resin such as a plastic material and having sandwiching portions 103 and 103 formed integrally with the opposite side edges of a rear portion of the base member 101 for sandwiching the outside guide means 52 therebetween. The sandwiching portions 103 and 103 are provided with through holes communicated with the through hole 57 in the outside guide means 51. A supporting shaft 104 is inserted through the through holes of the sandwiching portions 103 and 103, the through hole 57 of the outside guide means 51 and the through hole 44 of the grip portion 31 of the main body portion 12, and fixed in those through holes. The base member 101 is pivotally supported on the support shaft 104. Engagement projections 105 for engaging with the engagement/stopper portions 58 formed on the side portions 53 of the outside guide means 51 are formed integrally with the back surfaces of the sandwiching portions 103 and 103, and those engagement/stopper projections 105 are disposed above the engagement/stopper portions 58 to thereby prevent the base member 101 from being spread excessively even in the case when the stapler is lifted up by gripping the grip portion 32 of the main body portion 12 by hand. A coil spring 106 is attached to a portion of the upper surface of the base member 101 between the sandwiching portions 103 and 103 so that an upper end of the coil spring 106 is engaged with the lower surface of the staple guide portion 13. By the coil spring 106, a gap is normally kept between the base member 101 and the lower surface of the staple drive-out portion 15. Further, engagement projections 108 are provided on the respective back surfaces of the sandwiching portions 103 and 103 so as to elastically removably engage wth grooves 107 formed in the lower portion of the engagement/stopper projection 45 of the main body portion 12 when the base portion 16 is forcedly spread about the support shaft 104 by about 180 degrees from the state of FIG. 1.

Figure 18A:
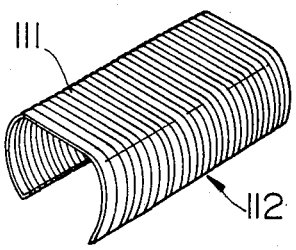
Figure 18B:
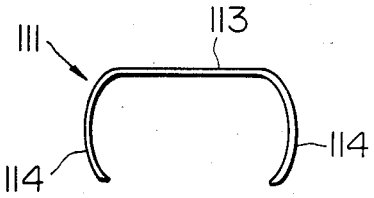

FIGS. 18*a* and 18*b* show staples 111 to be used in the stapler according to the present invention. Similarly to the conventional case, the staples 111 in the predetermined number are separably successively connected in the form of a bar of staples 112. As shown in FIG. 18*b*, each of the staples 111 has a substantially linear supporting portion 113 and a pair of opposite stapling leg portions 114 which extend downward in the inwardly curved state from the opposite ends of the support portion 113 respectively. That is, each leg portion 114 of the staple 111 is substantially arched. Each of the free ends of the stapling leg portions 14 is made sharp. The radius of curvature of each of the stapling leg portions 114 is made slightly smaller than that of the curved portion 82 of the guide member 79. The length of the supporting portion 113 of the staple 111 and the distance between the guide projections 85 and 85 of the staple drive-out plate member 72 are selected so that the upper surface of the supporting portion 113 of the staple 111 can substantially agree with the lower end edge portions of the staple drive-out plate member 72 between the guide projections 85 and 85 thereof. Further, the length of the supporting portion 113 of the staple 111 between the opposite corners thereof is selected to be slightly longer than the distance between the curved portions 82 and 82 of the foregoing guide member 79 at the respective lower ends thereof.

The foregoing constituent parts are assembled as follows. First, the coil spring 35 is inserted into the spring accommodating portion 33 of the main body portion 12, and the free end of the horizontal portion 88 of the spring receptor 87 of the staple drive-out plate member 72 is engaged with the lower surface of the projection portion 38 of the main body portion 12 while pressing the top end of the coil spring 35 by the horizontal portion 88. Next, the main body portion 12 is fitted into the staple guide portion 13 so that the through holes 41, 43, and 44 of the main body portion 12 are communicated with the through holes 55, 56, and 57 of the staple guide portion 13 respectively. Then, the outer peripheral frame 71 is attached to the main body portion 12 while sandwiching the spring accommodating portion 33 between the side surface portions 73 and 73 of the outer peripheral frame 71, so that the through holes 75 of the outer peripheral frame 71 are communicated with the through hole 39 of the main body portion 12, and the through holes 76 of the outer peripheral frame 71 are communicated with the through holes 55 of the staple guide portion 13. Then, fixing shafts 121 and 122 are fixedly inserted into those communicated through holes. At that time, the supporting shaft 90 of the staple drive-out plate member 72 is fitted into the elongated hole 77 of the front end surface portion 74 of the outer peripheral frame 71. Further, a fixing shaft 123 is fixedly inserted into the through holes 56 of the staple guide portions 13 and the through hole 43 of the main body portion 12 which is communicated with the former. The fixing shaft 123 is fixedly inserted into the through holes 56 of the staple guide portions 13 and the through hole 43 of the main body portion 12 which is communicated with the former. The fixing shafts 121, 122, and 123 may be arranged such that each of the fixing shafts 121, 122, and 123 is provided at its one end with a head portion having a dimension larger than that of its shaft body portion, the other end being made so as to be fixed by means of a nut, a spring washer, or the like. As a result, the front end portion of the outside guide means 51 abuts on the side surfaces of the guide members 79 and 79 to thereby define the staple drive-out opening under the guide members 79 and 79.

Next, after the coil spring 106 has been fixed between the sandwiching portions 103 and 103 of the base portion 16, the through holes of the sandwiching portions 103 and 103 are communicated with the through holes 57 of the staple guide portion 13, and the supporting shaft 104 is inserted into those through holes. In order to fix the coil spring 106 between the sandwiching portions 103 and 103, the coil spring is made to be substantially truncated-cone-shaped as shown in FIG. 1, the diameter of the coil spring at a lower end thereof being made to be slightly larger than the distance between the sandwiching portions 103 and 103, and grooves (not shown) for engagement with the lower end of coil spring 106 are provided in the respective back surfaces of the sandwiching portions 103 and 103 at the respective lower portions thereof. Thus, the coil spring 106 may be engaged at its lower end with those grooves. The supporting shaft 104 is provided at one end thereof with a head portion having a diameter larger than that of the body portion thereof, the other end of the supporting shaft 104 being made to be fixed by a nut, a spring washer, or the like. Next, the supporting shaft 25 is fixedly inserted into the through hole 42 of the main body portion 12 so as to project the opposite ends of the supporting shaft 25 from the side surfaces of the main body portion 12. When the rear end portion of the pressing lever portion 11 is pressed while the opposite end portions of the supporting shaft 25 are fitted in the guide grooves 27 of the pressing lever portion 11, the rear end opposite portions of the pressing lever portion 11 are spread because of its elasticity so that the opposite end portions of the supporting shaft 25 are fitted into the supporting holes 26 along the respective guide grooves 27. Finally, the staple push-out portion 15 is inserted into the staple guide portions 13 from the staple engagement portion 94 of the staple push-out portion 15 through the rear end opening portion of the staple guide portion 13, and the engagement/stopper portion 97 of the lever portion 93 is engaged with the engagement/-stopper hole 64 of the inside guide means 52.

Next, description will be made as to the stapling operation of the stapler according to the present invention.

The staple push-out portion 15 is taken out of the staple guide portion 13. Then, the stapling leg portions 114 of the bar 112 of staples 111 are made to agree with the gap between the side portions 53 of the outside guide means 51 and the side portions 61 of the inside guide means 52 with the supporting portions 113 made upside, and the bar 112 of staples 111 is gradually inserted into the staple guide portion 13. Next, the staple push-out portion 15 is inserted into the staple guide portion 13 from the staple engagement portion 94 at the front end of the staple push-out portion 15. When the staple abutment portions 99 of the staple engagement portion 94 at the front end thereof abut on the rear end one of the staples 111 in the form of the bar 112, the staple engagement portion 94 is not advanced toward the front end any longer, but only the rod member 92 is advanced, and as a result the engagement/stopper portion 97 of the lever portion 93 of the staple push-out portion 15 can be engaged with the engagement/stopper hole 64 of the inside guide means 52. Consequently, the coil spring 95 is compressed to thereby elastically press the staple engagement portion 94 in the front end direction, and therefore the staples 111 in the form of the bar 112 can be successively fed to the staple drive-out opening. After the staples 111 have been loaded in the stapler according to the present invention as described above, if the pressing lever portion 11 is pressed toward the staple drive-out portion 14 while a thumb is put on the uneven portion 29 of the roof plate 24 of the pressing lever portion 11, the staple drive-out member 28 provided on the back surface of the roof plate 24 moves down in the outer peripheral frame 71 against the elastic force of the coil spring 35 to thereby cause the spring receptor 87 to move down.

Figure 19A:
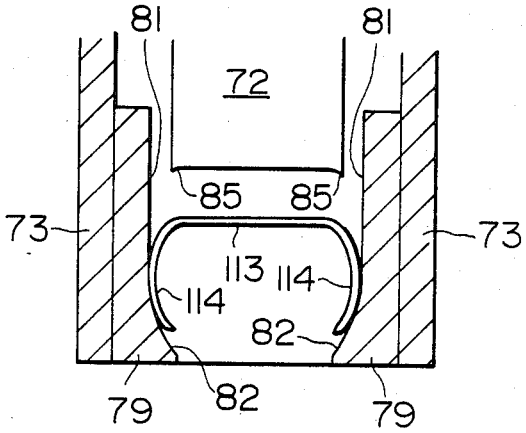
Figure 19B:
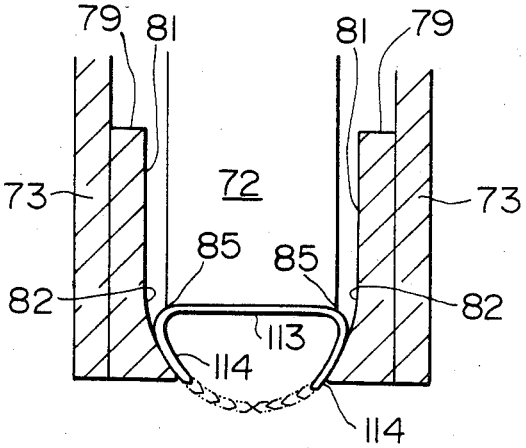

The staple drive-out plate member 72 moves down (FIG. 19*a*) as the spring receptor 87 moves down, so that the lower end of the staple drive-out plate member 72 hits against the supporting surface of the forwardmost staple 111 which abuts on the back surface of the front end surface portion 74 of the outer peripheral frame 71 to thereby separate the forwardmost staple 111 from the remainder staples of the bar 112. The thus separated forwardmost staple 111 and the staple drive-out plate member 72 are moved down through the gap between the linear portions 81 and 81 of the guide members 79 and 79 to come to the gap between the curved portions 82 and 82. Passing through the gap between the curved portions 82 and 82, the staple 111 is further curved as shown in FIG. 19*b* along the curvature of the curved portions 82 and 82. Since the gap between the lower end portions of the curved portions 82 and 82 is slightly smaller than the length of the supporting portion 113 of the staple 111, the stapling leg portions 114 of the staple 111 are pinned into an object to be stapled while the respective free ends of the stapling leg portions 114 are bent slantingly inward in opposition to each other. When the staple drive-out plate member 72 further moves down, the supporting portion 113 of the staple 111 is passed between the lower end portions of the curved portions 82 and 82. At that time, the staple 111 cannot pass here unless the staple 111 is curved to a some extent because the gap between the lower end portions of the curved portion 82 and 82 is smaller than the length of the supporting portion 113 as described above. Accordingly, force transmitted from the curved portions 82 and 82 onto the stapling leg portions 114 of the staple 111 has a component to make the respective free ends of the stapling leg portions 114 approach each other and a component to make the supporting portion 113 curve upward. Being abutting on the lower end edge portion of the staple drive-out plate member 72 between the guiding projections 85 and 85 thereof, however, the supporting portion 113 cannot be curved upward and the stapling leg portions 114 are further curved. When the staple 111 is passed finally between the lower ends of the curved portions 82 and 82, the supporting portions 113 is pressed down by the lower end edge portion of the staple drive-out plate member 72 between the guiding projections thereof so that the opposite end corner portions of the supporting portion 113 are further curved inward, whereby a sheet of paper 126 such as a slip or the like can be fastened on an object such as corrugated cardboard 125 to be stapled with the paper 126, in such a state as shown in FIG. 20.

Figure 20:
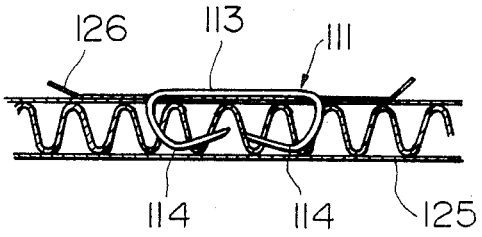
FIG. 20 is a longitudinal cross section showing the state where the staple is driven in corrugated cardboard.
Figure 21:
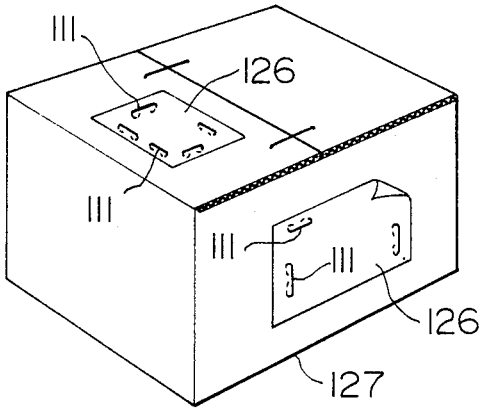
FIG. 21 is a perspective view showing the state when labels are being fastened on a corrugated carton by the stapler according to the present invention.

In the case where the sheet of paper 126 such as a slip or the like is fastened on the corrugated cardboard 125 or the like as shown in FIG. 20, the base portion 16 is rotated counterclockwise in the drawing about the supporting shaft 104 from the state of FIG. 1. As a result, the engagement/stopper portions 105 of the base portion 16 are passed over the engagement/stopper portions 58 provided at the side portions 53 of the outside guide means 51 to thereby make disengagement between the base portion 16 and the outside guide means 51, so that the base portion 16 becomes rotatable. Then, if the base portion 16 is rotated counter-clockwise by about 180 degrees from the state, the engagement projections 108 of the base portion 16 are fitted into the grooves 107 formed at the lower portion of the engagement/stopper projection 45 of the main body portion 12 to thereby make it possible to keep the base portion 16 substantially parallel to the lower surface of the outside guide means 51. Therefore, the stapling operation is never hindered by the base portion 16 in the case where the sheet of paper 126 as described above is fastened on the corrugated cardboard 125 or the like. Further, when the pressing lever portion 11 and the grip portion 32 are gripped by hand so as to drive a staple 111 while putting a thumb on the uneven portion 29 of the pressing lever portion 11 and hanging the four remainder fingers on the grip portion 32, the force for driving the staple 111 is not exerted onto a box 127. Therefore, as shown in FIG. 21, it is possible to fasten the sheet of paper 126 such as a slip or the like on a desired surface portion of the box 127 of corrugated cardboard or plywood in which the base portion 16 of the stapler cannot be disposed on the lower surface of the desired surface portion of the box 127.

When the stapler according to the present invention is used in the same manner as a generally-used stapler for stapling sheets of paper or for stapling flaps of the box, the base portion 16 is returned to the position as shown in FIG. 1, a portion to be stapled to the objects is put on the guide groove 102, and the pressing lever portion 11 is pressed downward by putting fingers on the uneven portion 29. In that case, although the objects can be stapled together by using the foregoing staple 111 when a stack of the objects to be stapled is thin, the conventional staple which is bent into a rectangular shape may be used when the stack is so thick. In this case, it is necessary to select the conventional staple having a supporting portion which is not longer than the gap between the lower end portions of the curved portions 82 and 82.

Figure 17:
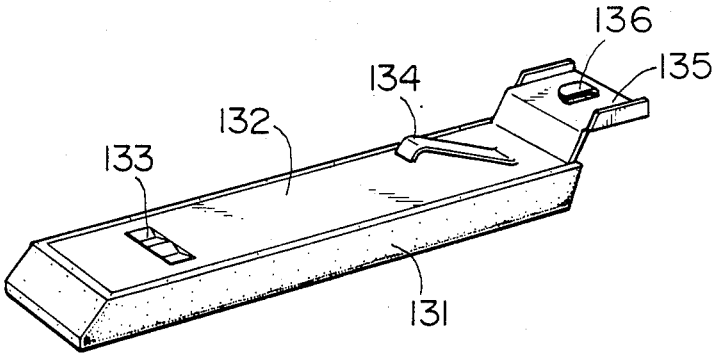
FIG. 17 is a perspective view showing another embodiment of the base portion.

Further, although the base portion 16 is pivotally supported by the main body portion 12 in the foregoing embodiment, the base portion 16 may be removably supported as shown in FIG. 17. That is, a base portion 131 is formed to have the same size as that of the base portion 16 of the foregoing embodiment, and a metal plate 132 extending from a front end of the base portion 131 to a rear end of the same is fixed on the upper surface of the base portion 131. This metal plate 132 acting as a matrix is provided at its front end portion with a guide groove 133 for bending the stapling leg portions 114 of the staple 111. The metal plate 132 is provided at its rear portion with a spring member 134 which is elastically engaged at its upper end with the bottom portion 54 of the outside guide means 51 so as to form a gap between the bottom portion 54 of the outside guide means 51 and the metal plate 132. A rear end portion 135 of the metal plate 132 is formed to be slightly higher than the surface in which a hook-shaped engagement/-stopper portion 136 is provided. An engagement/stopper hole (not shown) which is engaged with the engagement/stopper portion 136 is formed in the bottom portion 54 of the outside guide means 51. The base portion 131 may be removed in use in the case where a sheet of paper 126 is fastened on the surface of a box 127 or the like as shown in FIG. 21, and may be attached again through engagement between the engagement/-stopper portion 136 and the engagement/stopper hole of the bottom portion 54 of the outside guide means 51 in the case where sheets of paper are stapled together as a generally-used stapler.

Although the present invention has been described with reference to the preferred embodiments, the foregoing explanation is performed in order to understand the present invention, and therefore it is a matter of course that various modifications of the preferred embodiments can be made without departing from the scope of the appended claims.

What is claimed is:

1. A stapler adapted to receive staples therein, comprising:

a main body portion having front and rear end portions, and a grip portion between the front and rear end portions so that the grip portion is adapted to be grasped by hand of a user, a staple drive-out portion attached to the front end portion of the main body portion, said staple drive-out portion including means for pushing the staples out of the staple drive-out portion having a staple drive-out plate member and a spring receptor attached to the staple drive-out plate member, a spring for urging the staple drive-out plate member upwardly, and a staple drive-out opening, said staple drive-out plate member being situated in the staple drive-out opening, said staple drive-out opening being formed by linear portions parallel to each other and curved portions extending downwardly from the linear portions so that the width of the staple drive-out opening is gradually reduced at the curved portions, a staple guide portion attached to the main body portion, said staple guide portion retaining the staples therein and urging the staples toward the staple drive-out portion, a pressing lever situated above the main body portion and pivotally connected to the rear end portion of the main body portion, said pressing lever being urged upwardly by means of the spring and having a projection beneath the pressing lever, said projection abutting against the spring receptor so that the force for stapling operation can be substantially directly applied from the pressing lever to the staple drive-out plate member, said pressing lever, when pushed relative to the main body portion, actuating the staple drive-out plate member of the pushing means so that the staple is inwardly bent while passing through the staple drive-out opening and is ejected from the staple drive-out portion, a base portion pivotally connected to the rear end portion of the main body portion, said base portion having a guide groove for bending the staple when the base portion is situated under the main body portion and the staple is pushed onto the guide groove, engagement stopper portions formed on the main body and the base portion, respectively, said engagement stopper portions retaining the base portion under the main body when the engagement stopper portions engage with each other, and an engagement projection formed at a rear portion of the base portion, and grooves formed at the rear end portions of the main body portion, said engagement projection engaging the grooves when the base portion situated under the main body portion is rotated relative to the main body portion, whereby the base portion is retained at a position away from the underside of the main body portion, and the staple is directly applied to an object without being hindered by the base portion.

* * * * *